US009412300B2

(12) United States Patent
Wang et al.

(10) Patent No.: US 9,412,300 B2
(45) Date of Patent: Aug. 9, 2016

(54) PIXEL COMPENSATING CIRCUIT AND METHOD OF ORGANIC LIGHT EMITTING DISPLAY

(71) Applicants: Shanghai Tianma AM-OLED Co., Ltd., Shanghai (CN); Tianma Micro-Electronics Co., Ltd., Shenzhen (CN)

(72) Inventors: Zhiliang Wang, Shanghai (CN); Dong Qian, Shanghai (CN); Liyuan Luo, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 14/479,572

(22) Filed: Sep. 8, 2014

(65) Prior Publication Data

US 2015/0356919 A1 Dec. 10, 2015

(30) Foreign Application Priority Data

Jun. 4, 2014 (CN) ..... 2014 1 0245542

(51) Int. Cl.
*G09G 3/30* (2006.01)
*G09G 3/32* (2016.01)

(52) U.S. Cl.
CPC ..... *G09G 3/3241* (2013.01); *G09G 2300/0814* (2013.01); *G09G 2300/0819* (2013.01); (Continued)

(58) Field of Classification Search
CPC ..... G09G 3/30; G09G 3/32; G09G 3/34; G09G 3/36; G09G 3/10; G09G 5/00; G09G 3/038
USPC ..... 345/77, 80, 82–83, 204, 206, 691; 315/169.3, 291
See application file for complete search history.

(56) References Cited

U.S. PATENT DOCUMENTS 9,084,331 B2 * 7/2015 Li ..... H05B 33/0896
9,117,407 B2 * 8/2015 Kim ..... G09G 3/3233
(Continued)

FOREIGN PATENT DOCUMENTS

CN 101471032 A 7/2009
CN 103021333 A1 4/2013
(Continued)

OTHER PUBLICATIONS

Office Action for German Application No. 102014113867.8, mailed on May 6, 2015, 6 pages total.

*Primary Examiner* — Pegeman Karimi
(74) *Attorney, Agent, or Firm* — Alston & Bird LLP

(57) ABSTRACT

A pixel compensating circuit includes a first transistor, a second transistor, a third transistor, a fourth transistor, a fifth transistor, a driving transistor, a first capacitor, and an organic light emitting diode element. The first transistor controls transmission of a data signal to a first electrode plate of the first capacitor. The second transistor controls transmission of a reference voltage signal to the first electrode plate of the first capacitor. The driving transistor determines an amount of a driving current. The third transistor controls connection and disconnection between the gate electrode and a drain electrode of the driving transistor. The fourth transistor transmits the driving current from the driving transistor to the organic light emitting diode element. The fifth transistor controls transmission of a supply voltage to the source electrode of the driving transistor; and the organic light emitting diode element emits light in response to the driving current.

16 Claims, 9 Drawing Sheets

(52) U.S. Cl.
CPC ..... *G09G2300/0842* (2013.01); *G09G 2300/0861* (2013.01); *G09G 2300/0866* (2013.01); *G09G 2310/08* (2013.01); *G09G 2320/0223* (2013.01); *G09G 2320/0233* (2013.01); *G09G 2320/043* (2013.01); *G09G 2320/045* (2013.01)

(56) References Cited

U.S. PATENT DOCUMENTS

| | | | | |
|---|---|---|---|---|
| 2005/0057459 | A1* | 3/2005 | Miyazawa | G09G 3/3233 345/76 |
| 2005/0269959 | A1* | 12/2005 | Uchino | G09G 3/2011 315/169.3 |
| 2006/0103322 | A1* | 5/2006 | Chung | G09G 3/3233 315/169.3 |
| 2011/0193855 | A1* | 8/2011 | Han | G09G 3/3233 345/214 |
| 2011/0273420 | A1* | 11/2011 | Liu | G09G 3/3233 345/211 |
| 2013/0194248 | A1 | 8/2013 | Kim | |

FOREIGN PATENT DOCUMENTS

| | | | |
|---|---|---|---|
| CN | 103927975 | A | 7/2014 |
| DE | 60306107 | T2 | 1/2007 |
| EP | 1496495 | A2 | 1/2005 |

* cited by examiner

PIXEL COMPENSATING CIRCUIT AND METHOD OF ORGANIC LIGHT EMITTING DISPLAY

CROSS-REFERENCES TO RELATED APPLICATIONS

This application claims the benefit of priority to Chinese Patent Application No. 201410245542.5, filed with the Chinese Patent Office on Jun. 4, 2014 and entitled "PIXEL COMPENSATING CIRCUIT AND METHOD OF ORGANIC LIGHT EMITTING DISPLAY", the content of which is incorporated herein by reference in its entirety.

BACKGROUND OF THE INVENTION

1. Technical Field

The present disclosure relates to the field of organic light emitting display technologies, in particular to a pixel compensating circuit and method of compensating for voltage drop and drift occurring in the threshold voltage of an organic light emitting display device.

2. Technical Background

An organic light emitting display is a thin film light emitting device that is made of organic semiconductor material and driven by a direct voltage, and includes a very thin organic material coating and a glass substrate. Such organic material of the organic material coating can emit light actively when a current flows therethrough.

FIG. 1 is a schematic diagram showing a pixel driving circuit of an organic light emitting display in the prior art. A working process of the pixel driving circuit includes: a signal writing stage and a light emitting stage. In the signal writing stage, when a scanning signal Scan is at a high level, a transistor T12 is turned on to input a data signal Data to a gate electrode of a driving transistor T11 to turn on the driving transistor T11 to charge a capacitor C11; while in the light emitting stage, the scanning signal Scan is at a low level, the transistor T12 is hence turned off, the capacitor C11 enables the driving transistor T11 to be turned on, and a supply voltage signal PVDD continues providing a voltage for the organic light emitting display, until a next signal writing stage arrives. As such, the two stages repeats as above.

Since a light emitting luminance of the organic light emitting display depends on an amount of the current flowing through the organic light emitting diode, the light emitting luminance, as an electrical property of the driving thin film transistor, will directly affect an display effect of the organic light emitting display, and especially a threshold voltage of the driving thin film transistor often drifts, leading to an uneven luminance problem in the whole organic light emitting display.

BRIEF SUMMARY OF THE INVENTION

In one aspect, an embodiment of the present disclosure discloses a pixel compensating circuit of an organic light emitting display, including: a first transistor, a second transistor, a third transistor, a fourth transistor, a fifth transistor, a driving transistor, a first capacitor and an organic light emitting diode element. The first transistor is controlled by a first driving signal to control transmission of a data signal to a first electrode plate of the first capacitor; the second transistor is controlled by a second driving signal to control transmission of a reference voltage signal to the first electrode plate of the first capacitor; the driving transistor is configured to determine an amount of a driving current which depends on a voltage difference between a gate electrode and a source electrode of the driving transistor; the third transistor is controlled by the first driving signal to control connection and disconnection between the gate electrode and a drain electrode of the driving transistor; the fourth transistor is controlled by a third driving signal to transmit the driving current from the driving transistor to the organic light emitting diode element; the fifth transistor is controlled by a fourth driving signal to control transmission of a supply voltage to the source electrode of the driving transistor; a cathode of the organic light emitting diode element is connected to a low potential, and the organic light emitting diode element is configured to emit light in response to the driving current.

In another aspect, an embodiment of the present disclosure discloses a pixel compensating method of a pixel compensating circuit, where, the first transistor, the second transistor, the third transistor, the fourth transistor, the fifth transistor and the driving transistor are P-type transistors; or the first transistor, the second transistor, the third transistor, the fourth transistor and the fifth transistor are N-type transistors, but the driving transistor is a P-type transistor; the method includes a node resetting step, a threshold detecting step, a data inputting step and a light emitting step.

In yet another aspect, an embodiment of the present disclosure discloses an organic light emitting display, including: the pixel compensating circuit and organic light emitting diode elements, where, the organic light emitting diode elements emit light in response to the driving current outputted by the pixel compensating circuit.

DETAILED DESCRIPTION OF THE INVENTION

The present disclosure will be further illustrated in detail below in conjunction with the accompanying drawings and specific embodiments. It may be understood that specific embodiments described herein are merely for explaining the present disclosure rather than limiting the present disclosure. Additionally, it is noted that merely partial contents associated with the present disclosure rather than all contents are illustrated in the accompanying drawings for ease of description.

Figure 1:
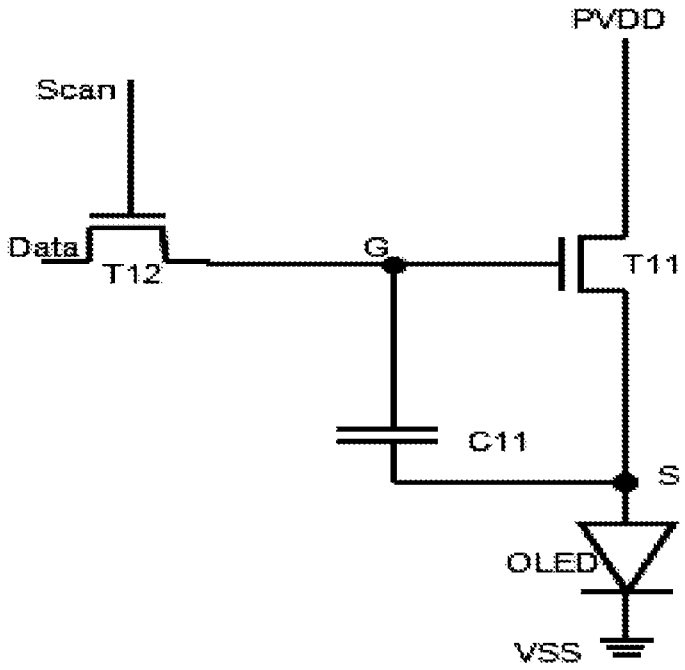
FIG. 1 is a schematic diagram showing a pixel driving circuit of an organic light emitting display in the prior art.
Figure 2:
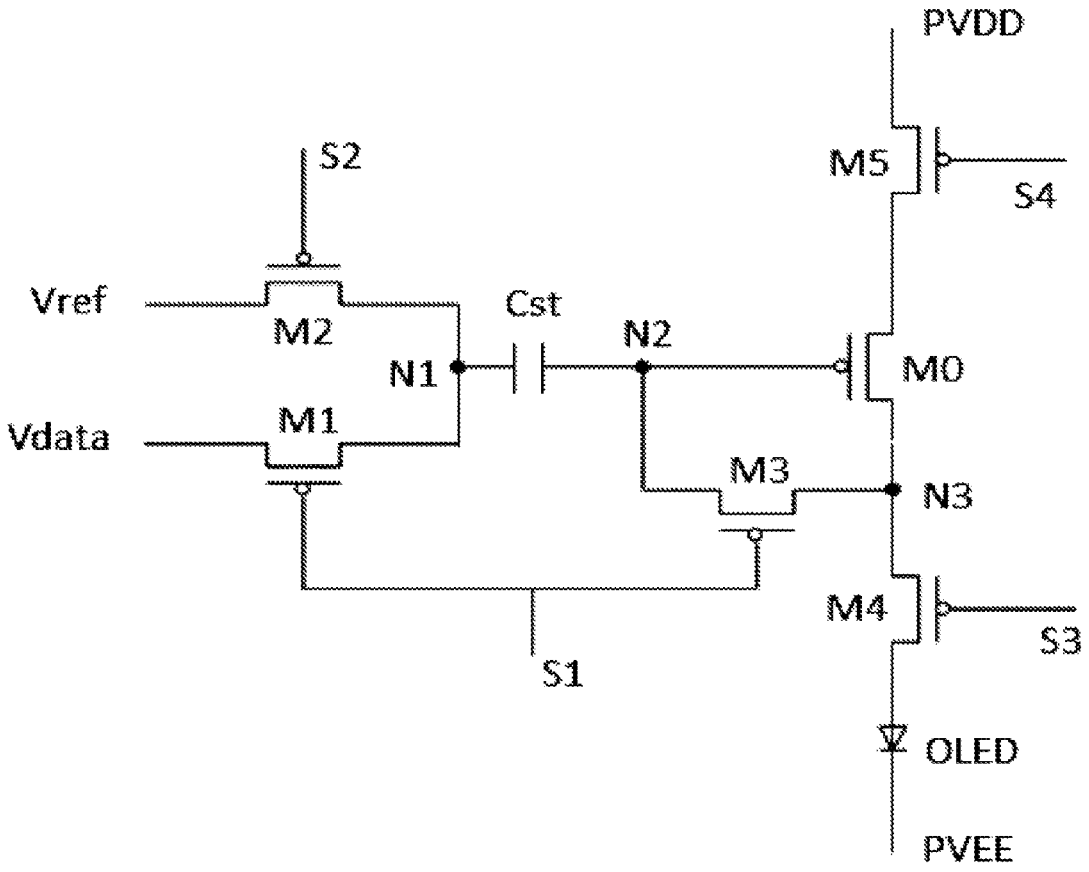
FIG. 2 is a schematic diagram showing a pixel compensating circuit of an organic light emitting display according to an embodiment of the present disclosure.

FIG. 2 is a schematic diagram showing a pixel compensating circuit of an organic light emitting display according to an embodiment of the present disclosure. As shown in FIG. 2, the pixel compensating circuit of the present embodiment includes a first transistor M1, a second transistor M2, a third transistor M3, a fourth transistor M4, a fifth transistor M5, a driving transistor M0, a first capacitor Cst and an organic light emitting diode element OLED.

A first electrode of the first transistor M1 is connected with a data signal line to receive a data signal Vdata, and a second electrode of the first transistor M1 is connected with a second electrode of the second transistor M2 and a first electrode plate of the first capacitor Cst; a first electrode of the second transistor M2 is connected with a reference voltage signal line to receive a reference voltage signal Vref; a source electrode of the driving transistor M0 is connected with a second electrode of the fifth transistor M5, and a drain electrode of the driving transistor M0 is connected with a second electrode of the third transistor M3 and a first electrode of the fourth transistor M4; a first electrode of the third transistor M3 is connected with a gate electrode of the driving transistor M0 and a second electrode plate of the first capacitor Cst; a second electrode of the fourth transistor M4 is connected with the organic light emitting diode element OLED; and a first electrode of the fifth transistor M5 is connected with a supply voltage signal line to receive a supply voltage signal PVDD.

In the pixel compensating circuit of the present embodiment, the first transistor M1 is controlled by a first driving signal S1 to control the transmission of the data signal Vdata to the first electrode plate of the first capacitor Cst; the second transistor M2 is controlled by a second driving signal S2 to control the transmission of the reference voltage signal Vref to the first electrode plate of the first capacitor Cst; the driving transistor M0 is configured to determine an amount of a driving current which depends on a voltage difference between the gate electrode and the source electrode of the driving transistor M0; the third transistor M3 is controlled by the first driving signal S1 to control the connection and disconnection between the gate electrode and the drain electrode of the driving transistor M0; the fourth transistor M4 is controlled by a third driving signal S3 to transmit the driving current from the driving transistor M0 to the organic light emitting diode element OLED; the fifth transistor M5 is controlled by a fourth driving signal S4 to control the transmission of the supply voltage signal PVDD to the source electrode of the driving transistor; and the organic light emitting diode element OLED is configured to emit light in response to the driving current.

Figure 3:
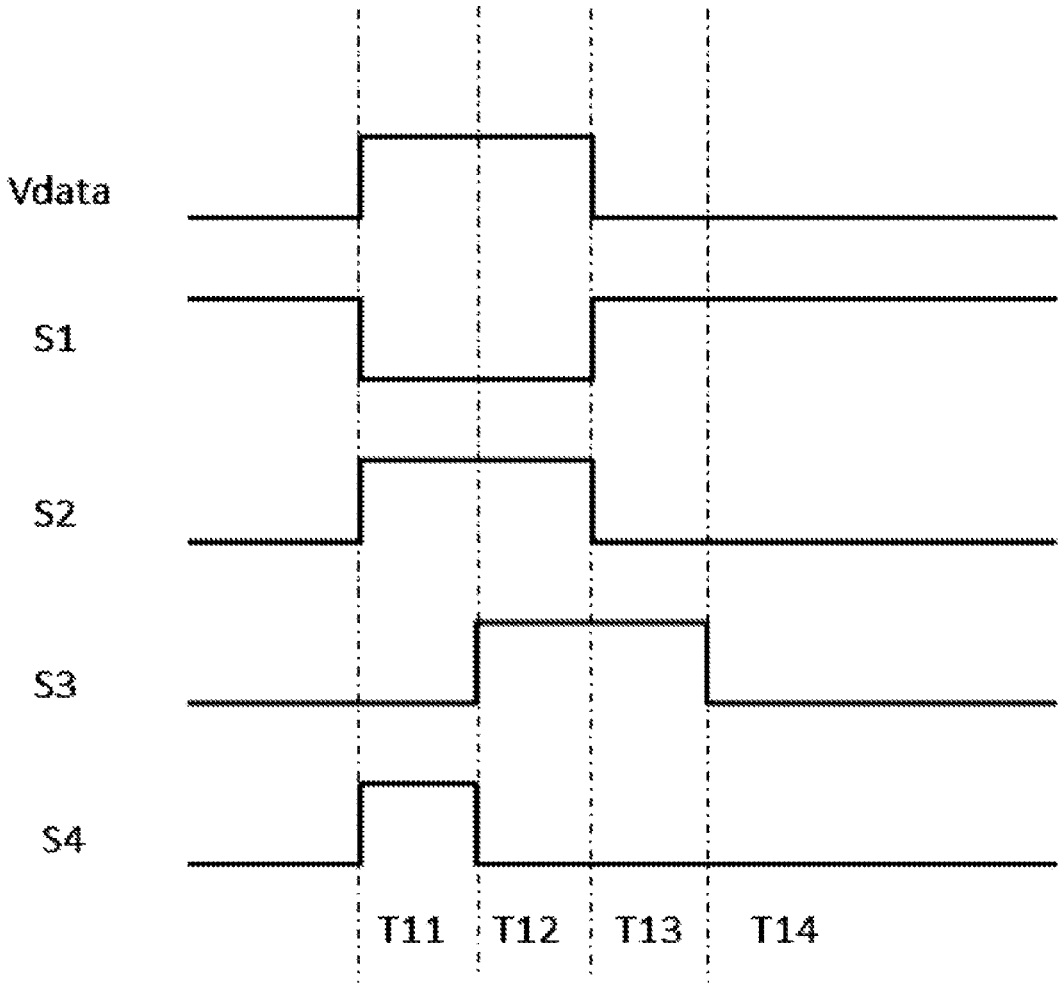
FIG. 3 is a timing diagram showing driving signals of the pixel compensating circuit of the organic light emitting display according to an embodiment of the present disclosure.

FIG. 3 is a timing diagram showing driving signals of the pixel compensating circuit of the organic light emitting display according to an embodiment of the present disclosure. It is noted that the timing diagram shown in FIG. 3 is merely an example, in which all of the first transistor M1, the second transistor M2, the third transistor M3, the fourth transistor M4, the fifth transistor M5, and the driving transistor M0 are P-type transistors, correspondingly.

Specifically, the first driving signal S1 controls the first transistor M1 and the third transistor M3, the second driving signal S2 controls the second transistor M2, the third driving signal S3 controls the fourth transistor M4, and the fourth driving signal S4 controls the fifth transistor M5, where, Vdata represents the data signal. All of the first driving signal S1, the second driving signal S2, the third driving signal S3 and the fourth driving signal S4 are provided by gate driving lines of the organic light emitting display.

A driving timing of the pixel compensating circuit of the embodiment includes a node resetting stage, a threshold detecting stage, a data inputting stage and a light emitting stage, respectively corresponding to time periods of T11, T12, T13 and T14 in FIG. 3.

Figure 4:
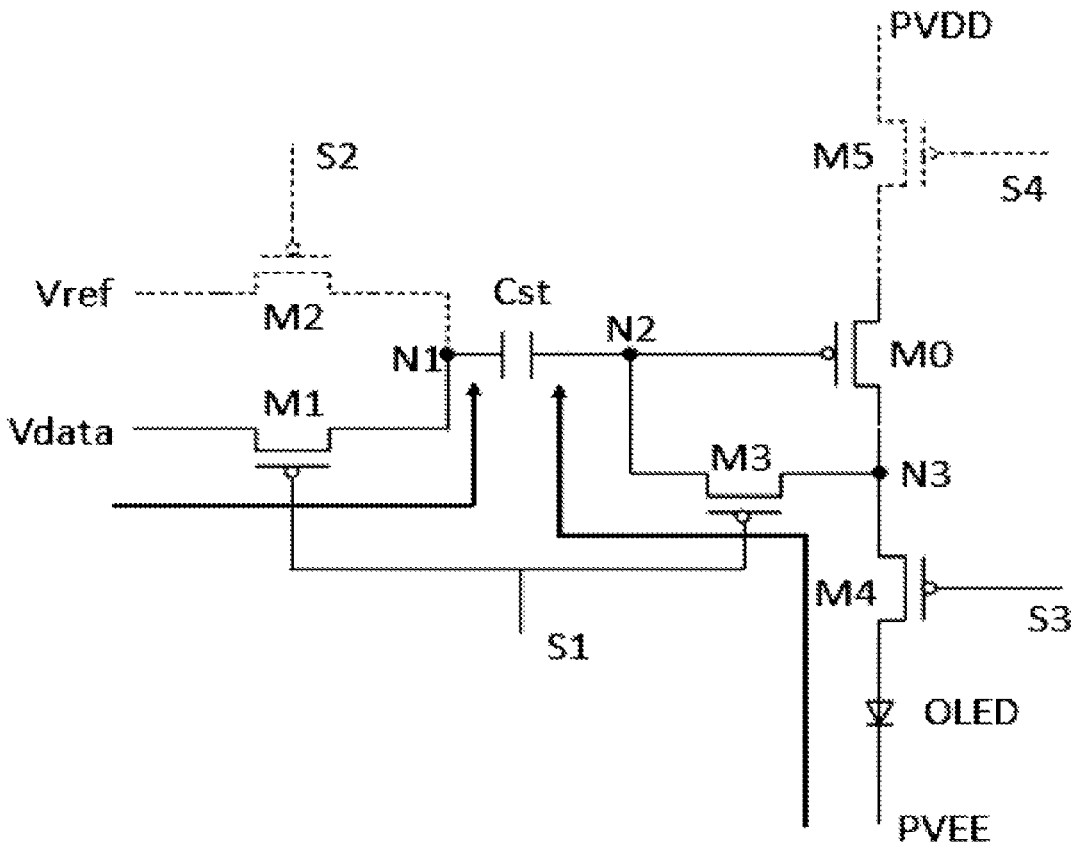
FIG. 4 is a schematic diagram showing a current path of the pixel compensating circuit of the organic light emitting display in a node resetting stage T11 according to an embodiment of the present disclosure.
Figure 5:
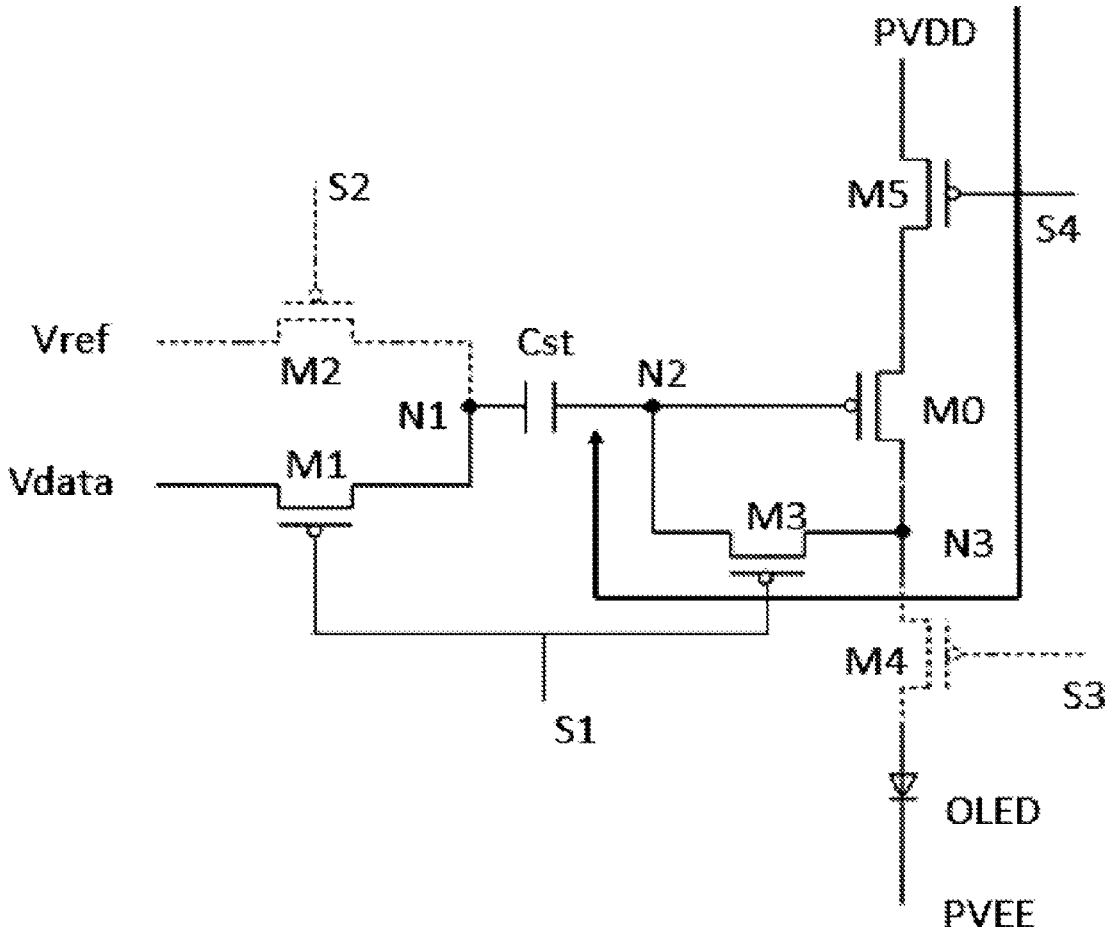
FIG. 5 is a schematic diagram showing a current path of the pixel compensating circuit of the organic light emitting display in a threshold detecting stage T12 according to an embodiment of the present disclosure.
Figure 6:
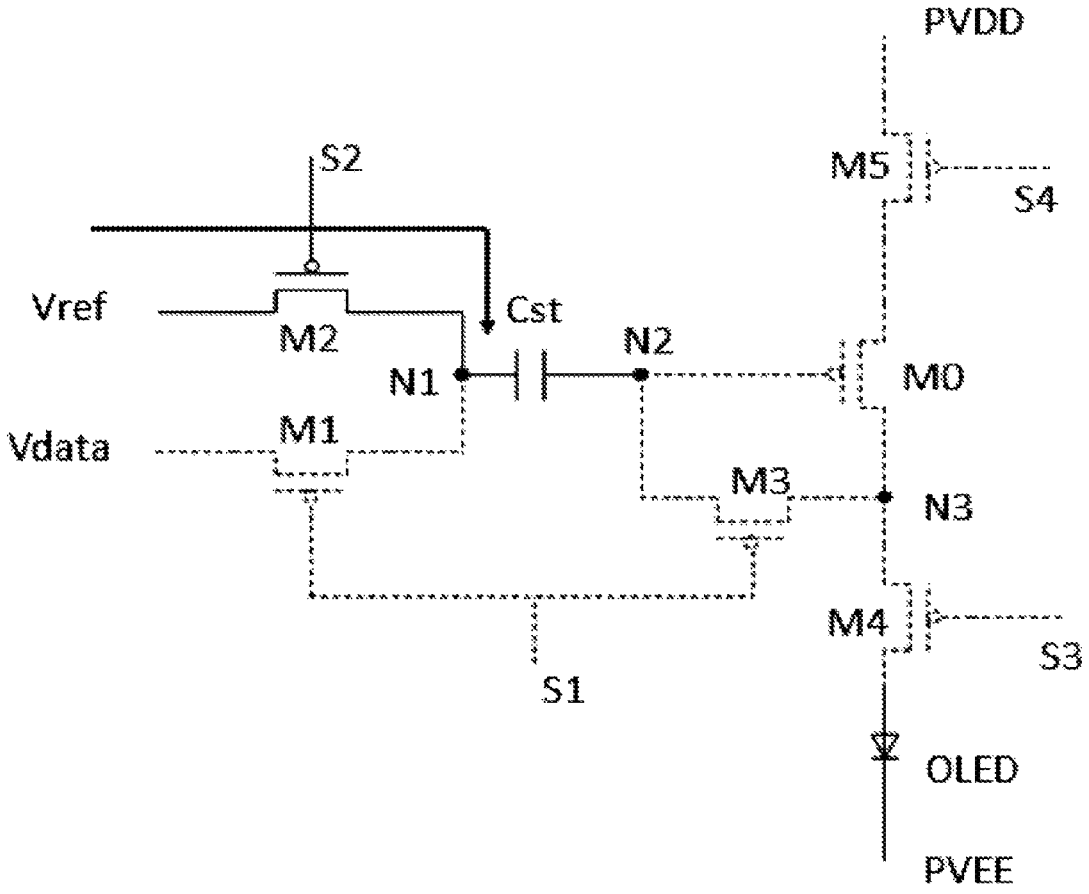
FIG. 6 is a schematic diagram showing a current path of the pixel compensating circuit of the organic light emitting display in a data inputting stage T13 according to an embodiment of the present disclosure.
Figure 7:
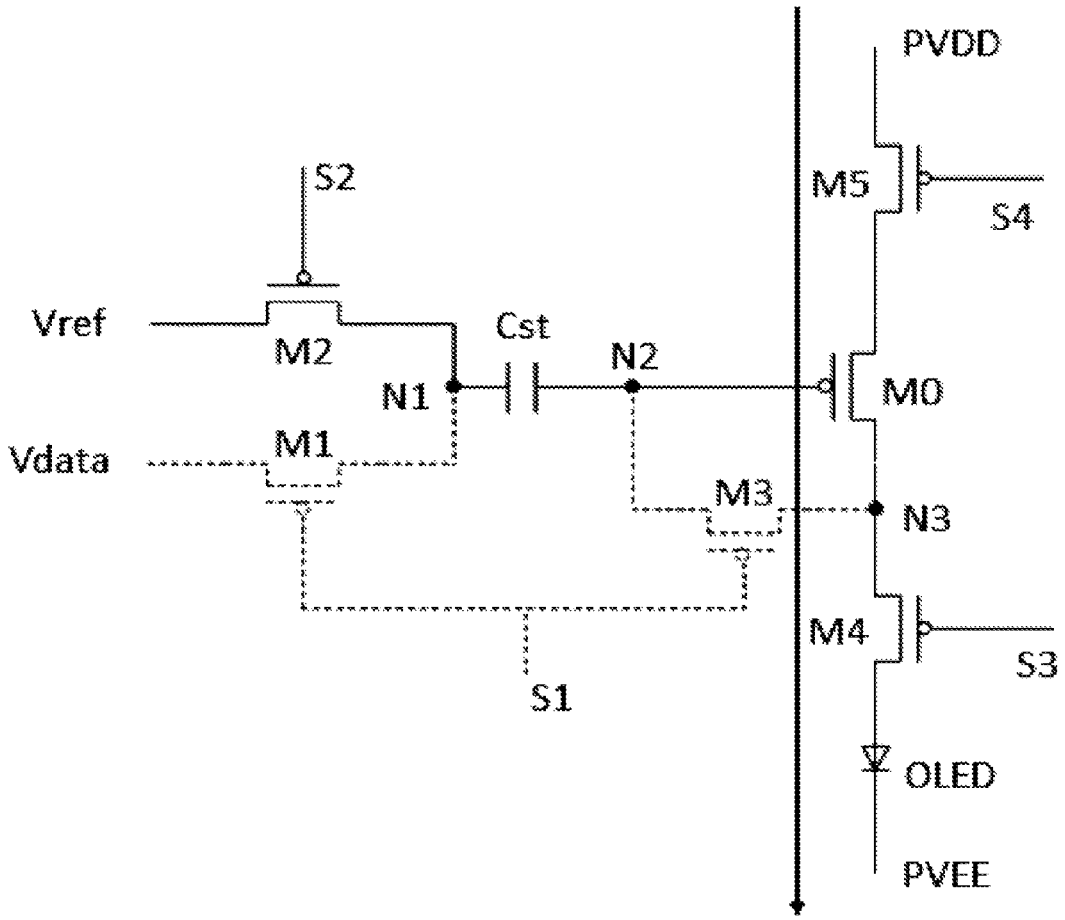
FIG. 7 is a schematic diagram showing a current path of the pixel compensating circuit of the organic light emitting display in a light emitting stage T14 according to an embodiment of the present disclosure.

FIG. 4 is a schematic diagram showing a current path of the pixel compensating circuit of the organic light emitting display in a node resetting stage T11. FIG. 5 is a schematic diagram showing a current path of the pixel compensating circuit of the organic light emitting display in a threshold detecting stage T12. FIG. 6 is a schematic diagram showing a current path of the pixel compensating circuit of the organic light emitting display in a data inputting stage T13, and FIG. 7 is a schematic diagram showing a current path of the pixel compensating circuit of the organic light emitting display in a light emitting stage T14. For sake of description, current paths in various stages are indicated by arrows in FIGS. 4 to 7, where, active elements are indicated by solid lines and inactive elements are indicated by dashed lines.

An operating principle of the pixel compensating circuit of the organic light emitting display according to an embodiment of the present disclosure is illustrated specifically below with reference to FIGS. 2 to 7.

As shown in FIGS. 3 and 4, in the node resetting stage T11, the first driving signal S1 is at a low level, so that both of the first transistor M1 and the third transistor M3 are turned on; the second driving signal S2 is at a high level, so that the second transistor M2 is turned off; the third driving signal S3 is at a low level, so that the fourth transistor M4 is turned on; and the fourth driving signal S4 is at a high level, so that the fifth transistor M5 is turned off. As can be seen from FIG. 4, the data signal Vdata is transmitted to a first node N1 (i.e., the first electrode plate of the first capacitor Cst) through the first transistor M1, while a current path is formed between the third transistor M3 and the fourth transistor M4 so that the potential at a second node N2 is brought to a low potential PVEE of the cathode of the organic light emitting diode element OLED through the current path, i.e., both of the second electrode plate of the first capacitor Cst and the gate electrode of the driving transistor M0 are at a low potential, thereby implementing a node resetting process in the pixel compensating circuit. In the node resetting process, the fifth transistor M5 is turned off, so that the supply voltage signal PVDD is disconnected from the driving transistor M0, the fourth transistor M4 and the light emitting diode element OLED, thereby reducing the current flowing through the light emitting diode element OLED in the resetting process, decreasing the luminance under a dark state, and improving a contrast of the organic light emitting display product.

As shown in FIGS. 3 and 5, in the threshold detecting stage T12, the first driving signal S1 is at a low level, so that both of the first transistor M1 and the third transistor M3 are turned on; the second driving signal S2 is at a high level, so that the second transistor M2 is turned off; the third driving signal S3 is at a high level, so that the fourth transistor M4 is turned off; and the fourth driving signal S4 is at a low level, so that the fifth transistor M5 is turned on. As can be seen from FIG. 5, in the node resetting stage T11, since the gate electrode of the driving transistor M0 is at a low potential to cause the driving transistor M0 to be turned on, a current path is formed between the driving transistor M0 and the third transistor M3, so that the supply voltage signal PVDD is transmitted to the second node N2 through the current path, thus the potential of the second node N2 is pulled up gradually by the supply voltage signal PVDD. Based on its voltage-current characteristics, the transistor is turned off when the voltage difference between the gate electrode and the source electrode of the transistor is less than the threshold voltage thereof, i.e., the driving transistor M0 is turned off when the voltage of the gate electrode of the driving transistor M0 is pulled up to such a level that the voltage difference between the gate electrode and the source electrode of the driving transistor M0 is less than or equal to the threshold voltage Vth of the driving transistor M0. Since the source electrode of the driving transistor M0 is connected with the supply voltage signal line and hence is constantly maintained at the potential PVDD, the potential at the gate electrode of the driving transistor M0 may be represented by PVDD-Vth when the driving transistor M0 is turned off, where PVDD represents the supply voltage and Vth represents the threshold voltage of the driving transistor M0.

At this time, a voltage difference Vc between the first electrode plate and the second electrode plate of the first capacitor Cst is calculated by formula (1) below:

$$Vc=V2-V1=PVDD-Vth-Vdata \quad (1),$$

where, V2 represents the potential of the second node N2 and V1 represents the potential of the first node N1.

In the threshold detecting stage T12, the voltage difference Vc between the first electrode plate and the second electrode plate of the first capacitor Cst includes the threshold voltage Vth of the driving transistor M0, i.e., the threshold voltage Vth of the driving transistor M0 has been detected in the threshold detecting stage T12, and is stored in the first capacitor Cst.

As shown in FIGS. 3 and 6, in the data inputting stage T13, the first driving signal S1 is at a high level, so that both of the first transistor M1 and the third transistor M3 are turned off; the second driving signal S2 is at a low level, so that the second transistor M2 is turned on; and the third driving signal S3 is at a high level, so that the fourth transistor M4 is turned off; in this case, the function of the pixel compensating circuit in the data inputting stage T13 would not be affected regardless of whether the fifth transistor M5 is turned on or off. As can be seen from FIG. 6, the reference voltage signal Vref is transmitted to the first node N1 (i.e., the first electrode plate of the first capacitor Cst) through the second transistor M2, while all of the third transistor M3, the fourth transistor M4 and the driving transistor M0 are turned off, i.e., the second electrode plate of the first capacitor Cst is disconnected, so that the voltage difference Vc between the first electrode plate and the second electrode plate of the first capacitor Cst keeps constant. However, since the potential of the first node N1 is changed to Vref, accordingly the potential of the second node N2 is changed to V2' as calculated below:

$$V2'=Vc+V1'=PVDD-Vth-Vdata+Vref \quad (2).$$

In other words, the data signal Vdata is coupled to the second electrode plate of the first capacitor Cst through the first Capacitor Cst.

As shown in FIGS. 3 and 7, in the light emitting stage T14, the first driving signal S1 is at a high level, so that both of the first transistor M1 and the third transistor M3 are turned off; the second driving signal S2 is at a low level, so that the second transistor M2 is turned on; the third driving signal S3 is at a low level, so that the fourth transistor M4 is turned on; and the fourth driving signal S4 is at a low level, so that the fifth transistor M5 is turned on. As can be seen from FIG. 7, a current path is formed between the driving transistor M0 and the fourth transistor M4, at this time, the voltage Vgs of the gate electrode of the driving transistor M0 is calculated below:

$$Vgs=V2'-PVDD=Vref-Vth-Vdata \quad (3).$$

Since the driving transistor M0 is operated in a saturation region, the driving current flowing through a channel of the driving transistor M0 is determined by the voltage difference between the gate electrode and the source electrode of the driving transistor M0, and the driving current can be obtained based on the electric characteristics of the transistor in the saturation region as follows:

$$I=K(Vsg-Vth)^2=K(Vref-Vdata)^2 \quad (4),$$

where, I represents the driving current generated by the driving transistor M0, K is a constant, Vref represents the reference voltage signal, and Vdata represents the data signal.

Since the fourth transistor M4 is operated in a linear region, the fourth transistor M4 can transmit the driving current I to the organic light emitting diode element OLED, to drive the organic light emitting diode element OLED to emit light for display.

In an implementation of the present embodiment, a signal line of the second driving signal S2 in a pixel can be connected with a signal line of the third driving signal in the preceding pixel, and the signal line of the third driving signal S3 in a pixel can be connected with the signal line of the second driving signal in the next pixel, so that the layout design of an integrated circuit board can further be simplified while implementing the pixel compensating function of the present disclosure.

It is noted that the first transistor M1, the second transistor M2, the third transistor M3, the fourth transistor M4 and the fifth transistor M5 may be N-type transistors but the driving transistor M0 is a P-type transistor in the present embodiment. It can be understood by those skilled in the art that functions of the above-mentioned steps can still be implemented if the first driving signal S1, the second driving signal S2, the third driving signal S3 and the fourth driving signal S4 described above are inversed, which will not be repeatedly described herein.

As can be seen from the above formula (4), the amount of the driving current I is only dependent on the reference voltage signal and the data signal and not dependent on the threshold voltage of the driving transistor and the supply voltage signal, so as to compensate the voltage drop on the power supply line and the threshold voltage, and ensure that in the whole driving process only one of the potentials at both sides of a storage capacitor is changed in order to reduce the impact of a coupling effect of the parasitic capacitor on the node potential, thereby achieving an accurate pixel compensating effect for the organic light emitting display and obtaining a better displaying effect.

Figure 8:
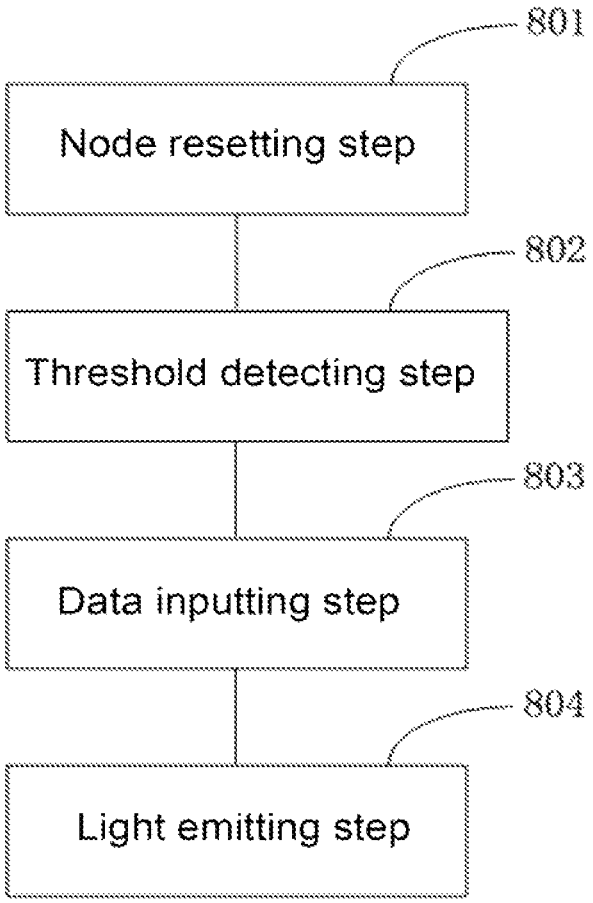
FIG. 8 is a flowchart showing a pixel compensating method of the organic light emitting display according to an embodiment of the present disclosure.

FIG. 8 is a flowchart showing a pixel compensating method of the organic light emitting display according to another embodiment of the present disclosure. In the embodiment, the pixel compensating circuit of the embodiment includes a first transistor M1, a second transistor M2, a third transistor M3, a fourth transistor M4, a fifth transistor M5, a driving transistor M0, a first capacitor Cst and an organic light emitting diode element OLED. In an exemplary embodiment, all of the first transistor M1, the second transistor M2, the third transistor M3, the fourth transistor M4, the fifth transistor M5 and the driving transistor M0 are P-type transistors. Referring to FIG. 2, the first transistor M1 has a first electrode connected with a data signal line to receive a data signal Vdata, and a second electrode connected with a second electrode of the second transistor M2 and a first electrode plate of the first capacitor Cst. The second transistor M2 has a first electrode connected with a reference voltage signal line to receive a reference voltage signal Vref. The driving transistor M0 has a source electrode connected with a second electrode of the fifth transistor M5 and a drain electrode connected with a second electrode of the third transistor M3 and a first electrode of the fourth transistor M4. The third transistor M3 has a first electrode connected with a gate electrode of the driving transistor M0 and a second electrode plate of the first capacitor Cst. The fourth transistor M4 has a second electrode connected with the organic light emitting diode element OLED. The fifth transistor M5 has a first electrode connected with a supply voltage signal line to receive a supply voltage signal PVDD.

As shown in FIG. 8, the pixel compensating method includes providing the above-described pixel compensating circuit to perform a node resetting step 801, a threshold detecting step 802, a data inputting step 803 and a light emitting step 804.

In the node resetting step 801:

specifically, in this step, both of the first driving signal and the third driving signal are at a low level, and both of the second driving signal and the fourth driving signal are at a high level, so that the first transistor, the third transistor, the fourth transistor and the driving transistor are turned on, and the second transistor and the fifth transistor are turned off. The data signal is transmitted to the first electrode plate of the first capacitor through the first transistor. The gate electrode of the driving transistor and the second electrode plate of the first capacitor Cst take on a low potential of the cathode of the organic light emitting diode element.

In the threshold detecting step 802:

specifically, in this step, the first driving signal is at a low level, the second driving signal is at a high level, the third driving signal changes from a low level to a high level, and the fourth driving signal changes from a high level to a low level, so that the first transistor, the third transistor and the fifth transistor are turned on, the second transistor and the fourth transistor are turned off, and the driving transistor is turned off when the voltage difference between the gate electrode and the source electrode of the driving transistor is equal to a threshold voltage of the driving transistor. When the driving transistor is turned off, the threshold voltage of the driving transistor is stored in the first capacitor.

In the data inputting step 803:

specifically, in this step, the first driving signal changes from a low level to a high level, the second driving signal changes from a high level to a low level, and the third driving signal is at a high level, so that the first transistor, the third transistor, the fourth transistor and the driving transistor are turned off, and the second transistor is turned on. The data signal is coupled to the second electrode plate of the first capacitor through the first capacitor. The reference voltage signal is transmitted to the first electrode plate of the first capacitor.

In the light emitting step 804:

specifically, in this step, the first driving signal is at a high level, the second driving signal is at a low level, the third driving signal changes from a high level to a low level, and the fourth driving signal is at a low level, so that the first transistor and the third transistor are turned off, and the second transistor, the fourth transistor and the fifth transistor are turned on, and the driving current of the driving transistor is determined by the voltage difference between the gate electrode and the source electrode of the driving transistor. The fourth transistor transmits the driving current to the organic light emitting diode element, and the organic light emitting diode element emits light in response to the driving current.

Figure 9:
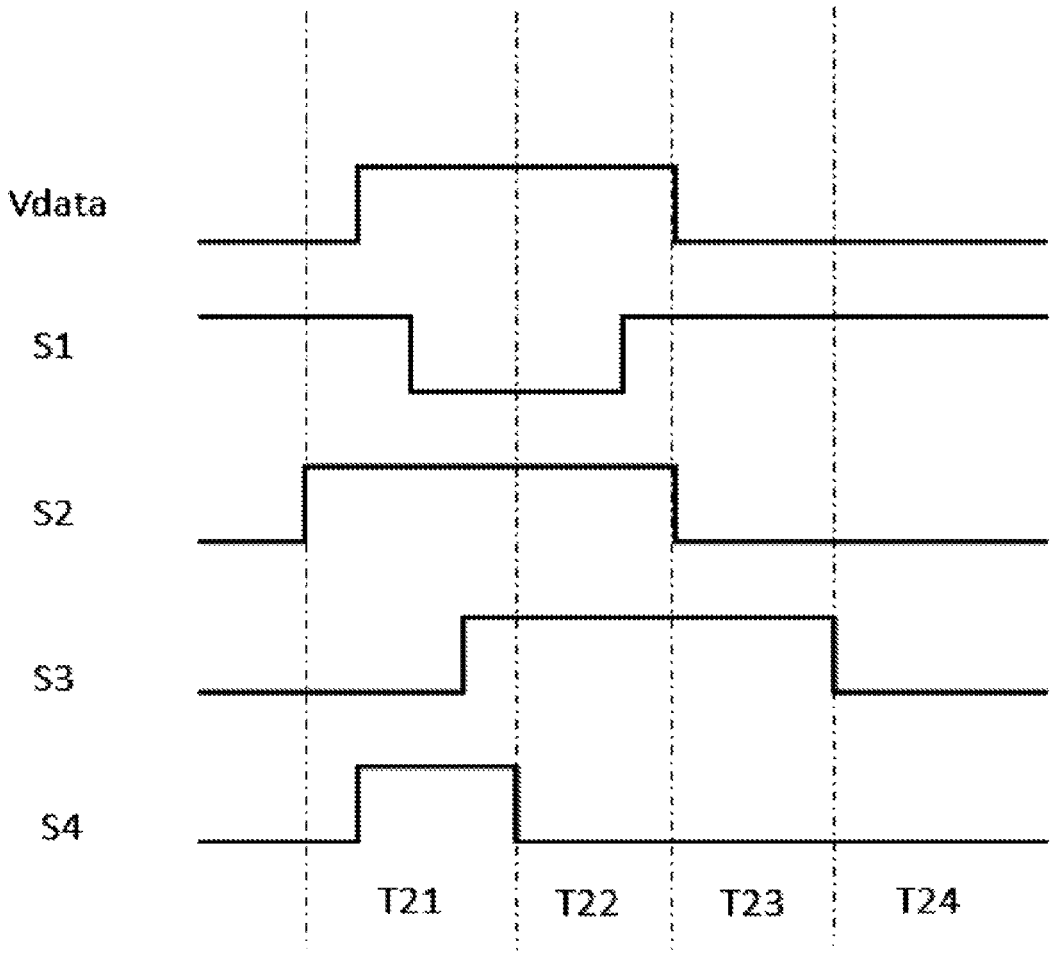
FIG. 9 is a timing diagram of driving signals according to an embodiment of the present disclosure.

FIG. 9 is a timing diagram showing driving signals according to an implementation of another embodiment of the present disclosure. As shown in FIG. 9, in the implementation of the present embodiment, in the node resetting step (i.e. within a timing T21), the data signal Vdata changes from a low level to a high level; and in the threshold detecting step (i.e. within a timing T22), the data signal Vdata changes from a high level to a low level. In addition, in the node resetting step (i.e. within the timing T21), the first driving signal S1 changes from a high level to a low level after the data signal Vdata changes from a low level to a high level; and in the threshold detecting step (i.e. within the timing T22), the first driving signal S1 changes from a low level to a high level before the data signal Vdata changes from a high level to a low level, i.e., a time period for which the first transistor M is turned on is slightly less than a time period during which the data signal Vdata is present, so that it is ensured that when the first driving signal S1 controls the first transistor M1 to turn on, the data signal Vdata is of course transmitted to the first node N1 (i.e., the first electrode plate of the first capacitor Cst) through the first transistor M1, thus keeping the data signal Vdata constant in the stage of turning on (i.e., a low level) of the first driving signal S1.

Further, in the node resetting step (i.e. within the timing T21), the fourth driving signal changes from a low level to a high level before the first driving signal changes from a high level to a low level; and the fourth driving signal changes again from a high level to a low level after the third driving signal changes from a low level to a high level. Since the nodes N1 and N2 are reset in the node resetting step (i.e. within the timing T21) only if both of the first driving signal S1 and the third driving signal S3 are at a low level and all of the first transistor M1, the third transistor M3 and the fourth transistor M4 are turned on, the reduction of the current flowing through the light emitting diode element OLED can be ensured as long as the fourth driving signal S4 is at a high level to turn off the fifth transistor in this step, thus decreasing the luminance under a dark state and improving a contrast of the organic light emitting display product.

In the present embodiment, the timings of the second driving signal S2 and the third driving signal S3 and of each signal in the data inputting step (i.e., within the timing T23) and the light emitting step (i.e. within the timing T24) are the same as those as previously described, and thus will not be repeated herein for the sake of brevity.

It is noted that in the present embodiment, the first transistor M1, the second transistor M2, the third transistor M3, the fourth transistor M4 and the fifth transistor M5 may also be N-type transistors but the driving transistor M0 may be a P-type transistor. It can be understood by those skilled in the art that functions of the above-mentioned steps can still be implemented as long as the first driving signal S1, the second driving signal S2, the third driving signal S4 and the fourth driving signal S4 described above are inverted. That is, when the first transistor, the second transistor, the third transistor and the fourth transistor are N-type transistors and the driving transistor is a P-type transistor.

In the node resetting step, both of the first driving signal and the third driving signal are at a high level and both of the second driving signal and the fourth driving signal are at a low level, so that all of the first transistor, the third transistor, the fourth transistor and the driving transistor are turned on, and the second transistor and the fifth transistor are turned off.

In the threshold detecting step, the first driving signal is at a high level, the second driving signal is at a low level, the third driving signal changes from a high level to a low level, and the fourth driving signal changes from a low level to a high level, so that all of the first transistor, the third transistor and the fifth transistor are turned on, the second transistor and the fourth transistor are turned off, and the driving transistor are turned off when the voltage difference between the gate electrode and the source electrode of the driving transistor is equal to a threshold voltage thereof.

In the data inputting step, the first driving signal changes from a high level to a low level, the second driving signal changes from a low level to a high level, and the third driving signal is at a low level, so that the first transistor, the third transistor, the fourth transistor and the driving transistor are turned off, and the second transistor is turned on.

In the light emitting step, the first driving signal is at a low level, the second driving signal is at a high level, the third driving signal changes from a low level to a high level, and the fourth driving signal is at a high level, so that the first transistor and the third transistor are turned off, and the second transistor, the fourth transistor and the fifth transistor are turned on, and the driving current of the driving transistor is determined by the voltage difference between the gate electrode and the source electrode of the driving transistor.

In the embodiment, the voltage drop on the power supply line and the threshold voltage drift are compensated and it is ensured that in the whole driving process only one of the potentials at both sides of the storage capacitor is changed in order to reduce the impact of a coupling effect of a parasitic capacitor on the node potential, thereby obtaining a better displaying effect.

It is noted that the preferred embodiments and the technology principles of the present disclosure are merely described as above. It will be understood by those skilled in the art that the disclosure is not limited to particular embodiments described herein. Various changes, readjustment and substitutions can be made to the present disclosure by those skilled in the art without departing from the scope of protection of the present disclosure. Therefore, although the disclosure is illustrated in detail through the above embodiments, it is not merely limited to the above embodiments, and can further include more others equivalent embodiments without departing from the conception of the present disclosure. The scope of the disclosure is determined by the accompanying claims.

What is claimed is:

1. A pixel compensating circuit of an organic light emitting display comprising: a first transistor, a second transistor, a third transistor, a fourth transistor, a fifth transistor, a driving transistor, a first capacitor, and an organic light emitting diode element; wherein:

the first transistor is controlled by a first driving signal to control transmission of a data signal to a first electrode plate of the first capacitor;

the second transistor is controlled by a second driving signal to control transmission of a reference voltage signal to the first electrode plate of the first capacitor;

the driving transistor is configured to determine a size of driving current which depends on a voltage difference between a gate electrode and a source electrode of the driving transistor;

the third transistor is controlled by the first driving signal to control connection and disconnection between the gate electrode and a drain electrode of the driving transistor;

the fourth transistor is controlled by a third driving signal to transmit the driving current from the driving transistor to the organic light emitting diode element;

the fifth transistor is controlled by a fourth driving signal to control transmission of a supply voltage to the source electrode of the driving transistor;

a cathode of the organic light emitting diode element is connected to a low potential, and the organic light emitting diode element is configured to emit light in response to the driving current; and wherein a driving timing of the pixel compensating circuit comprises a node resetting stage, a threshold detecting stage, a data inputting stage and a light emitting stage.

2. The pixel compensating circuit of claim 1, wherein:

a first electrode of the first transistor is connected with a data signal line, and a second electrode of the first transistor is connected with a second electrode of the second transistor and the first electrode plate of the first capacitor;

a first electrode of the second transistor is connected with a reference voltage signal line;

a source electrode of the driving transistor is connected with a second electrode of the fifth transistor, and a drain electrode of the driving transistor is connected with a second electrode of the third transistor and a first electrode of the fourth transistor;

a first electrode of the third transistor is connected with a gate electrode of the driving transistor and a second electrode plate of the first capacitor;

a second electrode of the fourth transistor is connected with the organic light emitting diode element; and a first electrode of the fifth transistor is connected with a supply voltage signal line.

3. The pixel compensating circuit of claim 2, where in the first transistor, the second transistor, the third transistor, the fourth transistor, the fifth transistor and the driving transistor are P-type transistors; or the first transistor, the second transistor, the third transistor, the fourth transistor and the fifth transistor are N-type transistors, but the driving transistor is a P-type transistor.

4. The pixel compensating circuit of claim 1, wherein the first driving signal, the second driving signal, the third driving signal and the fourth driving signal are provided by gate driving lines of the organic light emitting display.

5. The pixel compensating circuit of claim 1, wherein, in the node resetting stage, the fifth transistor is turned off, and the gate electrode of the driving transistor is brought to a low potential of the cathode of the organic light emitting diode element through the third transistor and the fourth transistor in order to control the driving transistor to turn on;

a data signal is transmitted to the first electrode plate of the first capacitor through the first transistor.

6. The pixel compensating circuit of claim 1, wherein, in the threshold detecting stage, a supply voltage signal is transmitted to the second electrode plate of the first capacitor under the control of the third transistor, the fifth transistor and the driving transistor, and the driving transistor is turned off when the voltage difference between the gate electrode and the source electrode of the driving transistor is equal to a threshold voltage of the driving transistor;

when the driving transistor is turned off, the threshold voltage of the driving transistor is stored in the first capacitor.

7. The pixel compensating circuit of claim 1, wherein, in the data inputting stage, the reference voltage signal is transmitted to the first electrode plate of the first capacitor through the second transistor, so that the data signal is coupled to the second electrode plate of the first capacitor through the first capacitor.

8. The pixel compensating circuit of claim 1, wherein, in the light emitting stage, the supply voltage signal is transmitted to the source electrode of the driving transistor through the fifth transistor, the driving transistor is configured for determining the size of the driving current which depends on the voltage difference between the gate electrode and the source electrode of the driving transistor, and the driving current is transmitted by the fourth transistor to the organic light emitting diode element;

the organic light emitting diode element emits light in response to the driving current.

9. A pixel compensating method for an organic light emitting display comprising:

providing a pixel compensating circuit comprising a first transistor, a second transistor, a third transistor, a fourth transistor, a fifth transistor, a driving transistor, a first capacitor, and an organic light emitting diode element having a cathode connected to a low potential, the organic light emitting diode element being configured to emit light in response to a driving current;

providing a first driving signal to enable the first transistor to transmit a data signal to a first electrode plate of the first capacitor;

providing a second driving signal to enable the second transistor to transmit a reference voltage signal to the first electrode plate of the first capacitor;

determining an amount of the driving current by the driving transistor, the amount of the driving current being dependent on a voltage difference between a gate electrode and a source electrode of the driving transistor;

enabling the third transistor by the first driving signal to control connection and disconnection between the gate electrode and a drain electrode of the driving transistor;

providing a third driving signal to enable the fourth transistor to transmit the driving current from the driving transistor to the organic light emitting diode element;

providing a fourth driving signal to enable the fifth transistor to transmit a supply voltage to the source electrode of the driving transistor;

wherein the method comprises:

a node resetting step of transmitting the data signal to the first electrode plate of the first capacitor, and bringing the gate electrode of the driving transistor and a second electrode plate of the first capacitor to the low potential of the cathode of the organic light emitting diode element;

a threshold detecting step of transmitting the supply voltage to the second electrode plate of the first capacitor and stored by the first capacitor;

a data inputting step of transmitting the reference voltage signal to the first electrode plate of the first capacitor, so that the data signal is coupled to the second electrode plate of the first capacitor and the gate electrode of the driving transistor; and a light emitting step of generating the driving current by the driving transistor to control the organic light emitting diode element to emit light.

10. The pixel compensating method of claim 9, wherein, in the node resetting step, in the event that the first transistor, the second transistor, the third transistor, the fourth transistor, the fifth transistor and the driving transistor are P-type transistors, setting the first driving signal and the third driving signal at a low level, and setting the second driving signal and the fourth driving signal at a high level to turn on the first transistor, the third transistor, the fourth transistor and the driving transistor, and to turn off the second transistor and the fifth transistor;

in the event that the first transistor, the second transistor, the third transistor, the fourth transistor and the fifth transistor are N-type transistors and the driving transistor is a P-type transistor, setting the first driving signal and the third driving signal at a high level, setting the second driving signal and the fourth driving signal are at a low level to turn on the first transistor, the third transistor, the fourth transistor and the driving transistor, and to turn off the second transistor and the fifth transistor.

11. The pixel compensating method of claim 9, wherein, in the threshold detecting step, in the event that the first transistor, the second transistor, the third transistor, the fourth transistor, the fifth transistor and the driving transistor are P-type transistors, the first driving signal is at a low level, the second driving signal is at a high level, changing the third driving signal from a low level to a high level, and changing the fourth driving signal from a high level to a low level, so that the first transistor to turn on the third transistor and the fifth transistor, turn off the second transistor and the fourth transistor, and turning off the driving transistor when the voltage difference between the gate electrode and the source electrode of the driving transistor is equal to a threshold voltage of the driving transistor;

in the event that the first transistor, the second transistor, the third transistor, the fourth transistor and the fifth transistor are N-type transistors and the driving transistor is a P-type transistor, the first driving signal is at a high level, the second driving signal is at a low level, changing the third driving signal from a high level to a low level, and changing the fourth driving signal from a low level to a high level to turn on the first transistor, the third transistor and the fifth transistor, turn off the second transistor and the fourth transistor, and turning off the driving transistor when the voltage difference between the gate electrode and the source electrode of the driving transistor is equal to a threshold voltage of the driving transistor.

12. The pixel compensating method of claim 9, wherein, in the data inputting step, in the event that the first transistor, the second transistor, the third transistor, the fourth transistor, the fifth transistor and the driving transistor are P-type transistors, changing the first driving signal from a low level to a high level, changing the second driving signal from a high level to a low level, and the third driving signal is at a high level to turn off the first transistor, the third transistor, the fourth transistor and the driving transistor and turn on the second transistor is turned on;

in the event that the first transistor, the second transistor, the third transistor, the fourth transistor and the fifth transistor are N-type transistors and the driving transistor is a P-type transistor, changing the first driving signal from a high level to a low level, changing the second driving signal from a low level to a high level, and the third driving signal is at a low level to turn off the first transistor, the third transistor, the fourth transistor and the driving transistor and turn on the second transistor.

13. The pixel compensating method of claim 9, wherein, in the light emitting step, in the event that the first transistor, the second transistor, the third transistor, the fourth transistor, the fifth transistor and the driving transistor are P-type transistors, the first driving signal is at a high level, the second driving signal is at a low level, changing the third driving signal from a high level to a low level, and the fourth driving signal is at a low level to turn off the first transistor and the third transistor and turn on the second transistor, the fourth transistor and the fifth transistor, and determining the driving current of the driving transistor by the voltage difference between the gate electrode and the source electrode of the driving transistor;

in the event that the first transistor, the second transistor, the third transistor, the fourth transistor and the fifth transistor are N-type transistors and the driving transistor is a P-type transistor, the first driving signal is at a low level, the second driving signal is at a high level, changing the third driving signal from a low level to a high level, and the fourth driving signal is at a high level, to turn off the first transistor and the third transistor and turn on the second transistor, the fourth transistor and the fifth transistor, and determining the driving current of the driving transistor by the voltage difference between the gate electrode and the source electrode of the driving transistor.

14. The pixel compensating method of claim 9, wherein, in the node resetting step, changing the data signal from a low level to a high level;

in the threshold detecting step, changing the data signal from a high level to a low level.

15. The pixel compensating method of claim 14, wherein, when the first transistor, the second transistor, the third transistor, the fourth transistor, the fifth transistor and the driving transistor are P-type transistors, in the node resetting step, after changing the data signal from a low level to a high level, changing the first driving signal from a high level to a low level;

before changing the first driving signal from a high level to a low level, changing the fourth driving signal from a low level to a high level;

after changing the third driving signal from a low level to a high level, changing the fourth driving signal again from a high level to a low level;

in the threshold detecting step, before changing the data signal from a high level to a low level, changing the first driving signal from a low level to a high level;

and wherein, when the first transistor, the second transistor, the third transistor, the fourth transistor and the fifth transistor are N-type transistors but the driving transistor is a P-type transistor, in the node resetting step, after changing the data signal from a low level to a high level, changing the first driving signal from a low level to a high level;

before changing the first driving signal from a low level to a high level, changing the fourth driving signal from a high level to a low level;

after changing the third driving signal from a high level to a low level, changing the fourth driving signal again from a low level to a high level;

in the threshold detecting step, before changing the data signal from a high level to a low level, changing the first driving signal from a high level to a low level.

16. An organic light emitting display comprising a pixel compensating circuit, the pixel compensating circuit comprising: a first transistor, a second transistor, a third transistor, a fourth transistor, a fifth transistor, a driving transistor, a first capacitor, and an organic light emitting diode element; wherein the first transistor is controlled by a first driving signal to control transmission of a data signal to a first electrode plate of the first capacitor;

the second transistor is controlled by a second driving signal to control transmission of a reference voltage signal to the first electrode plate of the first capacitor;

the driving transistor is configured to determine a size of driving current which depends on a voltage difference between a gate electrode and a source electrode of the driving transistor;

the third transistor is controlled by the first driving signal to control connection and disconnection between the gate electrode and a drain electrode of the driving transistor;

the fourth transistor is controlled by a third driving signal to transmit the driving current from the driving transistor to the organic light emitting diode element;

the fifth transistor is controlled by a fourth driving signal to control transmission of a supply voltage to the source electrode of the driving transistor;

a cathode of the organic light emitting diode element is connected to a low potential, and the organic light emitting diode element is configured to emit light in response to the driving current;

wherein the organic light emitting diode elements emit light in response to the driving current outputted by the pixel compensating circuit; and wherein a driving timing of the pixel compensating circuit comprises a node resetting stage, a threshold detecting stage, a data inputting stage and a light emitting stage.

* * * * *